United States Patent [19]

Sondal

[11] Patent Number: 4,860,907

[45] Date of Patent: Aug. 29, 1989

[54] CLOSURE FOR CONTAINERS

[75] Inventor: Sven Sondal, Lidingö , Sweden

[73] Assignee: Duma AB, Sweden

[21] Appl. No.: 278,181

[22] Filed: Nov. 30, 1988

[30] Foreign Application Priority Data

Dec. 8, 1987 [SE] Sweden ..... 8704884

[51] Int. Cl.[4] ..... B65D 41/48

[52] U.S. Cl. ..... 215/230; 215/235; 215/253; 215/256

[58] Field of Search ..... 215/235, 230, 237, 256, 215/253; 220/270

[56] References Cited

U.S. PATENT DOCUMENTS 3,438,529 4/1969 Lohrer ..... 215/253 X
4,129,226 12/1978 Percival ..... 215/235
4,702,383 10/1987 Wender ..... 215/230

FOREIGN PATENT DOCUMENTS 1265477 3/1972 United Kingdom ..... 215/256

*Primary Examiner*—Donald F. Norton

*Attorney, Agent, or Firm*—Ostrolenk, Faber, Gerb & Soffen

[57] ABSTRACT

A container closure formed in its closed state of a springy, elastomeric plastic, to be snapped onto the neck of a container with a ring-shaped retaining portion (2). The retaining portion (2) is connected via a hinge (10) to a re-closable lid (3). A tear-off strip is formed in the join between the lid and the retaining portion in the area opposite the hinge (10). The strip (4) is defined by scoring (6, 7) to diminish its strength. A seal is provided in the join between the lid (3) and the retaining portion (2), in the circumferential sections between the hinge (10) and the ends of the tear-off member (4), said seal being in the form of material bridges (5) spaced around the circumference of the closure. The tear-off strip (4) extends along approximately half the circumference of the closure and is connected with substantially rigid joins between the lid (3) and the retaining ring (2) so that the closure can be pressed onto the neck of the container without the material bridges (5) being broken. When the lid (3) is opened at the hinge (10) and the bridges (5) are thus broken, substantially by pure tensile stress, an accoustic signal will be obtained if the bridges (5) were unbroken.

4 Claims, 1 Drawing Sheet

CLOSURE FOR CONTAINERS

Figure 1:
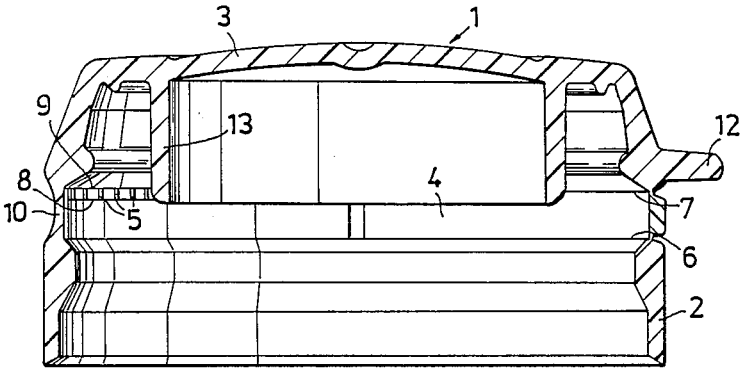

The present invention relates to a closure for containers formed in its closed state, comprising a retaining portion intended to retain the closure on the container, a lid portion hinged to the retaining portion, and a tear-off member located between the lid and the retaining portion, which initially holds these portions together in order to guarantee that the seal is unbroken.

Closures of the type described are usually made of a springy, elastomeric plastic material and are generally arranged so that in the closed state in which they are manufactured, they can easily be fitted into the neck of a container by being pressed on, for instance, so that an undercut rim on the inside of the retaining portion will grip below an undercut rim on the neck of the jar or bottle, ensuring that the closure cannot easily be removed from the container.

It is accepted that for closures of the type under discussion the tear-off member should not extend more than about half way around the circumference of the closure since certain categories of people would otherwise have difficulty in opening the closure.

On the other hand it is desirable for the closure to be sealed even along the part of the join between lid and retaining portion which is not covered by the sealing strip.

A seal having a substantially continuous score line is not suitable for the following reasons. First of all, it is more than likely that the cross section of the score lines will vary during production. This would not matter if it were a score line joining the long edge of a tear-off strip to the adjacent material, since the tear-off process would then involve shearing or tearing. However, in the present case the remaining material of the score line would merely be pulled off when the lid was lifted after removal of the tear-off strip.

A closure for containers is known through U.S. Pat. No. 4,531,650 which is of the type described in the introduction but which lacks any seal in the join between lid and base-ring in the circumferential area outside the tear-off strip. If a seal were to be produced in the join in this known closure, it might well be too strong, as mentioned above, and make opening the lid and removal of the tear-off strip too difficult. Furthermore, a continuous seal in the form of a score line would not be particularly suitable in providing a seal which can easily be checked.

One object of the invention is to provide a closure with a seal around the entire join between lid and retaining portion, but which is still easy to open. Another object of the invention is to produce a closure which, after removal of the strip, gives an accoustic signal confirming that the seal is intact at the time of lifting the lid.

Another object of the invention is to provide a closure where the seal between lid and retaining portion in the circumferential area outside the tear-off strip allows a simple visual check that the seal is unbroken.

According to the invention these objects are achieved with a closure of the type described in the introduction in that the tear-off member is located substantially opposite a hinge connecting the lid to the retaining portion, and that a plurality of easily broken bridges span the gap between lid and retaining portion in the circumferential section between the hinge and respective ends of the tear-off member.

A number of advantages are thus achieved. Since the bridges are located in the vicinity of the hinge, considerable force will be transmitted to assist in pulling off the material bridges when the lid is lifted after removal of the tear-off member. The cross-sectional dimensions of the material bridges are also relatively easy to control during production of the closures. Furthermore, since each bridge only has a small cross section, it will be broken substantially by pure tensile stress when the lid is lifted. The bridge will therefore be broken with a clearly audible snap when the lid is lifted and a series of bridges therefore provides obvious accoustic information that the seal in the join area between the tear-off strip and the hinge was intact. Furthermore, if the bridges extend over a gap of let us say one millimeter between lid and retaining portion, a simple visual inspection can be performed to check the integrity of the bridges prior to opening the closure. It is preferred that the tear-off member be defined by continuous score lines since this provides a relatively rigid join between the tear-off member and the lid and retaining portion respectively.

The tear-off member preferably extends around approximately one third of the circumference of the closure. However, it should be evident that the tear-off member may extend between 25% and 75% of the way around the circumference, the strip preferably extending over more than one third of the circumference. The tear-off part should preferably offer a firm force transmission between lid and retaining portion since the described bridges, particularly if they extend over an open gap, might otherwise be broken when the closure is fitted on the neck of the container.

Figure 2:
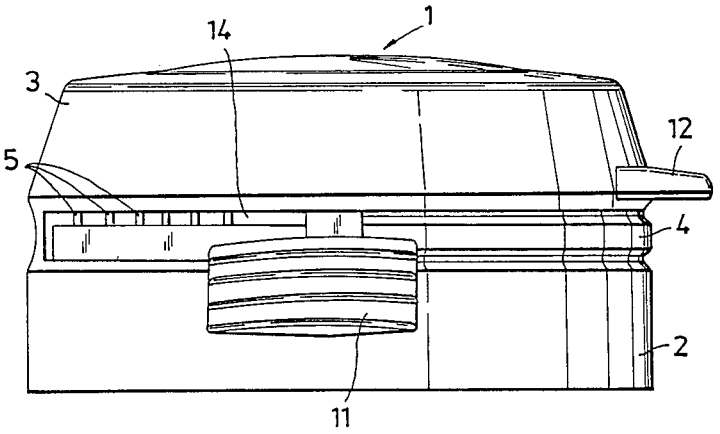

The invention will now be described in more detail with reference to the accompanying drawings in which FIG. 1 shows an axial section through a closure according to the invention, and FIG. 2 shows a side view of the closure according to FIG. 1.

The drawings show a closure 1 manufactured in the shown shape in one piece from a springy, elastomeric plastic material. The closure 1 comprises a retaining ring 2 with an internal bead along at least a part of its circumferene. The closure is designed to be pressed down over the neck of a container, the ring 2 expanding and then snapping in with the beading fitting into corresponding grooves on the outer side of the neck of the container, preferably so that the outside of the ring 2 is flush with the adjacent part of the outer side of the neck of the container. The closure 1 also comprises a lid 3 connected by a hinge 10 to the ring 2, allowing the container to be reclosed. The lid 3 is provided, internally with an axially directed flange 13 for cooperation with the inner wall surface of the neck of the container. A tear-off strip 4 is connected to the lid 3 and to the ring 2 along both its longitudinal edges 6, 7 via score lines in the annular wall of the closure 1. The score lines 6, 7 are thus continuous. A gripping tab 11 is integral with one end portion of the strip 4 to facilitate the tearing of this strip. The strip 4 extends along approximately half the circumference of the closure 1 in the area opposite the hinge 10. The lid 3 is also provided with an external tab 12 in the area opposite the hinge 10, to facilitate lifting the lid 3 after the strip 4 has been torn off. In the circumferential sections between the ends of the strip 4 and the hinge 10, the lid and the assembly ring 2 are separated by an opening 14, one millimeter in width, for instance. A number of material bridges 5 are spaced substantially uniformly along each gap 14 and extend between the defining edges 8 and 9 of the gaps 14.

The continuous seals defined by the score lines 6, 7 can easily be broken by tearing the strip 4 in the circumferential direction of the closure 1. However, it cannot be visually determined whether one or both the score lines 6, 7 have been broken or not.

After the strip 4 has been torn off it will be possible to break the bridges 5 substantially by pure tensile stress when the lid 3 is lifted, thus causing considerable force transmission around the hinge 10. A snapping noise will be clearly audible for each bridge 5 that is broken. When the lid is lifted, therefore, the series of bridges 5 will produce an accoustic signal in which the snapping rate will be dependent on the speed at which the lid 3 is opened and the varying distance of the bridges 5 to the hinge 10. The accoustic signal will give a clear indication of whether the seal defined by the bridges was broken or not before the lid 3 was opened. This enables even people with impaired vision to obtain an indication of the integrity of the seal. For people with normal vision, too, an accoustic signal of course gives an extra guarantee of the seal's integrity, particularly since it may be difficult even for a person with normal vision to determine whether the seal defined by the continuous score lines 6, 7 and the spaced bridges 5 has been broken or not.

The bridges 5 spaced according to the invention in the circumferential area between the tear-off strip 4 and the hinge 10 offers sealing of the join between lid 3 and assembly ring 2 in this area, and the characteristic feature of the seal utilizing spaced material bridges may then be a condition for being able at all to arrange a seal in this area in industrially produced closures of the type in question.

I claim:

1. A closure (1) for containers, formed in its closed state of a springy, elastomeric plastic material, comprising a retaining portion (2) intended to retain the closure (1) on the container, and a lid portion (3) hinged to the retaining portion (2) via a hinge (10), a tear-off member (4) being located between the lid (3) and the retaining portion (2) and initially holding these portions together in order to guarantee that the seal is unbroken, the tear-off member being located in the area opposite the hinge (10) and extending along 25–75% of the circumference of the closure, wherein a plurality of bridges spaced around the circumference are arranged between the lid and the retaining portion within the circumferential sections extending between the ends of the tear-off member (4) and the hinge (10).

2. A closure for containers as claimed in claim 1, wherein the gap spanned by the bridges (5) is open and preferably has a width of approximately one millimeter.

3. A closure as claimed in claim 2, wherein the tear-off member is defined by notches along its edges in tearing direction, said notches facilitating tearing of the member and at the same time leaving a seal between the tear-off member and the lid and between the tear-off member and the retaining portion before the member has been torn off.

4. A closure as claimed in claim 1, wherein the tear-off member (4) is defined by notches along its edges in tearing direction, said notches facilitating tearing of the member (4) and at the same time leaving a seal between the tear-off member and the lid and between the tear-off member and the retaining portion before the member (4) has been torn off.

* * * * *